US009485566B2

(12) United States Patent
Hou

(10) Patent No.: US 9,485,566 B2
(45) Date of Patent: Nov. 1, 2016

(54) MINIATURE SPEAKER MODULE, METHOD FOR ENHANCING FREQUENCY RESPONSE THEREOF AND ELECTRONIC DEVICE

(71) Applicant: Goertek Inc., Weifang (CN)

(72) Inventor: Kang Hou, Weifang (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 14/397,844

(22) PCT Filed: Jun. 5, 2014

(86) PCT No.: PCT/CN2014/079266

§ 371 (c)(1),
(2) Date: Oct. 29, 2014

(87) PCT Pub. No.: WO2015/074401

PCT Pub. Date: May 28, 2015

(65) Prior Publication Data

US 2016/0014501 A1 Jan. 14, 2016

(30) Foreign Application Priority Data

Nov. 19, 2013 (CN) ..... 2013 1 0583323

(51) Int. Cl.
*H04R 1/28* (2006.01)

(52) U.S. Cl.
CPC ..... *H04R 1/2811* (2013.01); *H04R 1/2819* (2013.01); *H04R 2499/11* (2013.01)

(58) Field of Classification Search
None
See application file for complete search history.

(56) References Cited

U.S. PATENT DOCUMENTS 5,009,281 A * 4/1991 Yokoyama ..... H04R 3/002 181/153
2008/0152168 A1* 6/2008 Magrath ..... H04R 5/04 381/100

FOREIGN PATENT DOCUMENTS

JP 02057095 A 2/1990
JP 2008048176 A * 2/2008

OTHER PUBLICATIONS

Written Opinion cited by the Chinese Patent Office in International Patent Application No. PCT/CN2014/079266 (Aug. 29, 2014).

*Primary Examiner* — Curtis Kuntz
*Assistant Examiner* — Kenny Truong
(74) *Attorney, Agent, or Firm* — Michael Best Friedrich LLP

(57) ABSTRACT

The present invention discloses a method for enhancing frequency response of a miniature speaker module, a miniature speaker module, and an electronic device. The method for enhancing frequency response of a miniature speaker module comprises the steps of: additionally providing an inverted tube in a rear cavity of the miniature speaker module to form a second driver in the inverted tube when an active driver works, the second driver and the active driver radiating jointly; and matching enhancement processing the input signals of the active driver according to the vibrating amplitude characteristics of the diaphragm of the active driver of the miniature speaker module additionally provided with the inverted tube. In the technical solutions provided by the present invention, as the frequency response of the whole miniature speaker module additionally provided with an inverted tube is enhanced on frequency bands below F0, and the signals are further matching enhancement processed according to the vibrating amplitude characteristics of the active driver, the frequency resource of the miniature speaker module on the whole frequency bands is enhanced greatly.

8 Claims, 6 Drawing Sheets

MINIATURE SPEAKER MODULE, METHOD FOR ENHANCING FREQUENCY RESPONSE THEREOF AND ELECTRONIC DEVICE

CROSS-REFERENCE TO RELATED APPLICATIONS

This is a U.S. national stage entry of International Patent Application No. PCT/CN2014/079266, filed on Jun. 5, 2014, which claims priority to Chinese Patent Application No. 201310583323.3, filed on Nov. 19, 2013, the entire contents of all of which are fully incorporated herein by reference.

TECHNICAL FIELD

The invention relates to the field of communication acoustics, in particular, to a miniature speaker module, a method for enhancing the frequency response of the miniature speaker module and an electronic device.

BACKGROUND ART

At present, in the field of communication acoustics, especially in the acoustics field of mobile terminal devices (e.g., mobile phones, PAD, notebook computers, etc.), a closed rear cavity design is adopted in most of the miniature moving-coil speaker modules, namely, an acoustically driven assembly is wrapped by a shell, and the entire rear cavity of the speaker module is closed. Due to the restriction from the size of the rear cavity and the volume of the product, the low frequency resonance point F0 of the miniature speaker module is high and cannot provide sufficiently low low-frequency dive. The relevant equalizer (EQ) and bass boost algorithms are all designed based on this kind of miniature speaker with a closed cavity. In the frequency band below F0, due to the restriction from the vibration amplitude of the existing diaphragm and the size of the components, the bass boost cannot be realized in an actual physical sense and the loudness is insufficient.

Moreover, in general, use of boost algorithm in a miniature speaker module will lead to temperature increase of voice coil and rear cavity when amplifying the amplitude of electrical signal, bringing potential damage to the reliability of the speaker component and the system. In the current closed-cavity design, usually there is only one small sound leakage port, which is insufficient to dissipate heat. Thus, heat is generally conducted out via a large metal frame or a thermally conductive sheet. However, such manner of dissipating heat by metal is harmful to the surrounding circuit of the device, especially to the antenna design.

SUMMARY OF THE INVENTION

In view of the above problems, the present invention provides a method for enhancing the frequency response of miniature speaker modules, a miniature speaker module, and an electronic device, to overcome the above problem or at least partially solve the above problem.

The technical solution of the invention for achieving the above purpose is carried out as follows:

According to one aspect of the invention, a method for enhancing the frequency response of a miniature speaker module is provided, the method comprising:

additionally providing an inverted tube in the rear cavity of the miniature speaker module to form a second driver in the inverted tube when an active driver works, the second driver and the active driver radiating jointly;

wherein, after the inverted tube is additionally provided in the miniature speaker module, the vibrating amplitude of a diaphragm of the active driver shows a local dip on frequency bands below a resonant frequency point F0, and the lowest point of the local dip is corresponding to a frequency point Fb; and matching enhancement processing the input signals of the active driver according to the vibrating amplitude characteristics of the diaphragm of the active driver of the miniature speaker module additionally provided with an inverted tube.

Alternatively, the miniature speaker module is of a front porting design, and the second driver formed in the inverted tube and the active driver radiate independently;

or, the miniature speaker module is of a side porting design, and the second driver formed in the inverted tube and the active driver radiate independently;

or, the miniature speaker module is of a front porting design, and the second driver formed in the inverted tube and the active driver share the front cavity and radiate jointly.

Alternatively, matching enhancement processing the input signals of the active driver according to the vibrating amplitude characteristics of the diaphragm of the active driver of the miniature speaker module additionally provided with an inverted tube comprises:

filtering out the signals below a first frequency point that is a frequency point lower than Fb, so as to filter out the signals having a vibrating amplitude beyond an allowable range of the diaphragm of the active driver on frequency bands below Fb;

band-pass filtering and enhancement processing the signals within a certain frequency band with Fb as a central frequency point, to achieve low-frequency dive and bass boost;

notch filtering the signals within a certain frequency band with F0 as a central frequency point, to avoid too large vibrating amplitude of the diaphragm of the active driver near F0; and high-pass filtering and enhancement processing the signals above a second frequency point higher than F0 to further enhance mid and high frequency output using the characteristics that the diaphragm of the active driver has a smaller vibrating amplitude in mid and high frequency bands.

Alternatively, the method further comprises:

adjusting Fb by changing the tube length and diameter of the inverted tube; and/or adjusting F0 by changing the diaphragm characteristics and voice coil quality of the active driver; and adjusting one or more of the following parameters of the filter in the matching enhancement process: Q value, order, frequency band attenuation parameter and cutoff frequency, according to the value of F0 and Fb and the characteristics of the power amplifier and the diaphragm's amplitude.

According to another aspect of the invention, a miniature speaker module is provided, the miniature speaker module comprising: a cavity, and an active driver disposed in the cavity, an inverted tube and a matching enhancement unit;

the inverted tube is disposed in the rear cavity to form a second driver in the inverted tube when an active driver works, the second driver and the active driver radiate jointly;

wherein, after additionally providing the inverted tube in the miniature speaker module, the amplitude of a diaphragm of the active driver shows a local dip on frequency bands below a resonant frequency point F0, and the lowest point of the local dip is corresponding to a frequency point Fb; and the matching enhancement unit is for matching enhancement processing the input signals of the active driver according to the vibrating amplitude characteristics of the diaphragm of the active driver of the miniature speaker module additionally provided with the inverted tube.

Alternatively, the miniature speaker module is of a front porting design, and the second driver formed in the inverted tube and the active driver radiate independently;

or, the miniature speaker module is of a side porting design, and the second driver formed in the inverted tube and the active driver radiate independently;

or, the miniature speaker module is of a front porting design, and the second driver formed in the inverted tube and the active driver share the front cavity and radiate jointly.

Alternatively, the matching enhancement unit comprises:

a very low frequency (VLF) filtering unit for filtering out the signals below a first frequency point that is a frequency point lower than Fb so as to filter out the signals having a vibrating amplitude beyond an allowable range of the diaphragm of the active driver on frequency bands below Fb;

a low frequency enhancement unit for band-pass filtering and enhancement processing the signal within a certain frequency band with Fb as a central frequency point, to achieve low-frequency dive and bass boost;

a low frequency reduction unit for notch filtering the signals within a certain frequency band with F0 as a central frequency point, to avoid too large vibrating amplitude of the diaphragm of the active driver near F0; and a high frequency enhancement unit for high-pass filtering and enhancement processing the signals above a second frequency point higher than F0 to further enhance mid and high frequency output using the characteristics that the diaphragm of the active driver has a smaller vibrating amplitude in mid and high frequency bands.

Alternatively, Fb is adjusted by changing the tube length and diameter of the inverted tube; and/or F0 is adjusted by changing the diaphragm property and voice coil quality of the active driver; and one or more of the following parameters of the filter in the matching enhancement process is adjusted: Q value, order, frequency band attenuation parameter and cutoff frequency, according to the value of F0 and Fb and the characteristics of the power amplifier of the system and the diaphragm's vibrating amplitude.

According to another aspect of the invention, an electronic device is provided, the electronic device comprising a miniature speaker as described above.

Alternatively, the electronic device may be a mobile phone, a tablet, a tablet television or a laptop.

According to the technical solution of the invention, by additionally providing an inverted tube in the miniature speaker module, a second driver formed in the inverted tube and the active driver radiate jointly such that the low frequency response of the miniature speaker module is enhanced; after additionally providing the inverted tube in the miniature speaker module, the amplitude of a diaphragm of the active driver shows a local dip on frequency bands below a resonant frequency point F0, and the lowest point of the local dip is corresponding to a frequency point Fb; and the input signals of the active driver are matching enhancement processed according to the amplitude characteristics of the diaphragm of the active driver of the miniature speaker module additionally provided with an inverted tube. By means of this technical solution, due to the matching enhancement process according to the amplitude characteristics of the active driver, the frequency response of the entire frequency bands of the miniature speaker module is greatly promoted, and meanwhile, the heat in the rear cavity can be conducted out well by additionally providing an inverted tube in the miniature speaker module, thereby effectively improving the system reliability and power cap.

DETAILED DESCRIPTION OF THE INVENTION

To make the object, technical solution and advantages of the present invention clearer, the embodiments of the invention are described in further detail with reference to the drawings.

Figure 1:
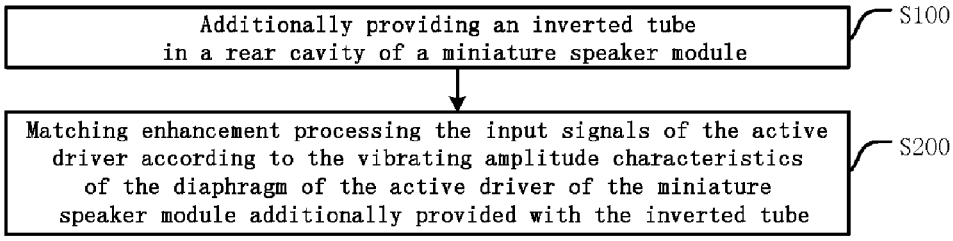
FIG. 1 is a flowchart showing a method for enhancing the frequency response of a miniature speaker module in an embodiment of the present invention.

FIG. 1 is a flowchart showing a method for enhancing the frequency response of a miniature speaker module in an embodiment of the invention. The method of this embodiment comprises:

S100, additionally providing an inverted tube in the rear cavity of the miniature speaker module to form a second driver in the inverted tube when an active driver works, the second driver and the active driver radiate jointly.

Specifically, by additionally providing an inverted tube in the rear cavity in the rear of the active driver of the miniature speaker module, the diaphragm of the active driver squeezes the air in the rear cavity when the active driver works, and thus a second driver is formed in the inverted tube. The second driver and the active driver radiate jointly such that the low-frequency response of the miniature speaker module is promoted.

After additionally providing the inverted tube in the miniature speaker module, the vibrating amplitude of the diaphragm of the active driver has a local dip in a frequency band below the resonance frequency point F0, and the lowest point in the local dip corresponds to the frequency point Fb.

S200, matching enhancement processing the input signals of the active driver according to the vibrating amplitude characteristics of the diaphragm of the active driver of the miniature speaker module additionally provided with an inverted tube.

In this embodiment, step S200 specifically comprises processing the input signals of the active driver as follows: band-pass filtering and enhancement processing the signals within a certain frequency band with Fb as a central frequency point, to achieve low-frequency dive and bass boost.

Or, in this embodiment, step S200 specifically comprises processing the input signals of the active driver as follows: filtering out the signals below a first frequency point that is a frequency point lower than Fb, so as to filter out the signals having an vibrating amplitude beyond an allowable range of the diaphragm of the active driver on frequency bands below Fb; band-pass filtering and enhancement processing the signals within a certain frequency band with Fb as a central frequency point, to achieve low-frequency dive and bass boost; notch filtering the signals within a certain frequency band with F0 as a central frequency point, to avoid too large vibrating amplitude of the diaphragm of the active driver near F0; and high-pass filtering and enhancement processing the signals above a second frequency point higher than F0, and further enhancing the mid and high frequency output using the characteristics that the diaphragm of the active driver has a smaller vibrating amplitude in mid and high frequency bands.

In this embodiment, the signals below the first frequency point are called very low-frequency (VLF) signals, which refer to that the amplitude of the diaphragm within this frequency band is larger and exceeds the allowable range of the diaphragm of the active driver (approximate to/reach/exceed the amplitude allowed by the diaphragm). Generally, VLF signals are filtered out using a high-pass filter. The filter cutoff frequency, i.e., the first frequency point, is determined by the vibrating amplitude curve of the diaphragm of the active driver and the property of the diaphragm itself, for example, the first frequency point can be selected as the frequency point at which the amplitude curve reaches the amplitude allowed by the diaphragm.

As for the miniature speaker module to which an inverted tube is additionally provided by the method as shown in FIG. 1, the frequency response of the miniature speaker module is improved in the low frequency below F0 by additionally providing the inverted tube, and the frequency response of the entire frequency bands of the miniature speaker module is greatly improved by further matching enhancement process. The method shown in FIG. 1 effectively enhances the frequency response of the miniature speaker module, provides adequate low frequency dive and loudness, and can be widely used in micro-electro-acoustic field, such as mobile phones, tablet PCs, flat panel televisions and laptops.

Figure 8:
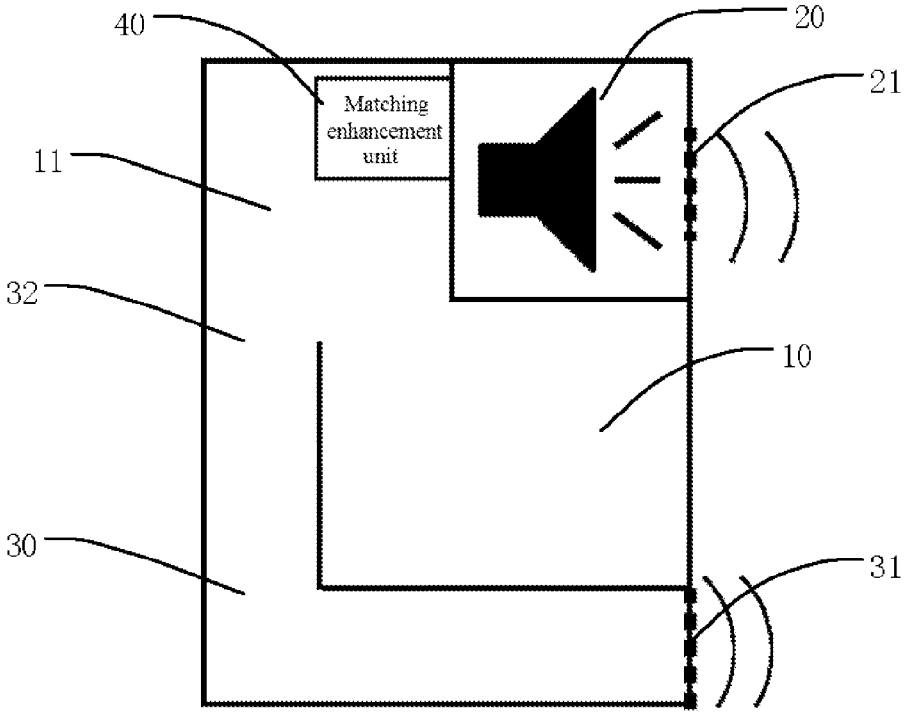
FIG. 8 is a diagram showing the first embodiment of the miniature speaker module of the invention.
Figure 10:
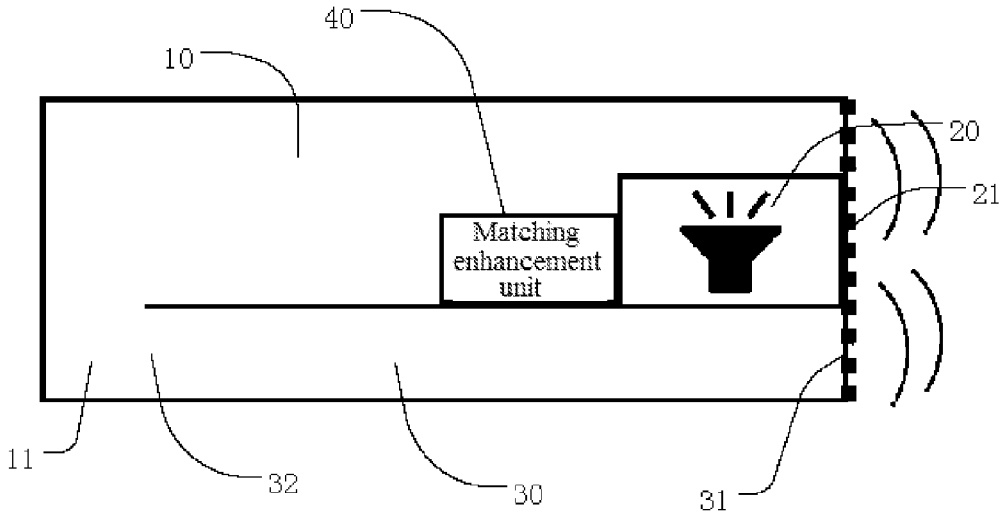
FIG. 10 is a diagram showing the second embodiment of the miniature speaker module of the invention.
Figure 11:
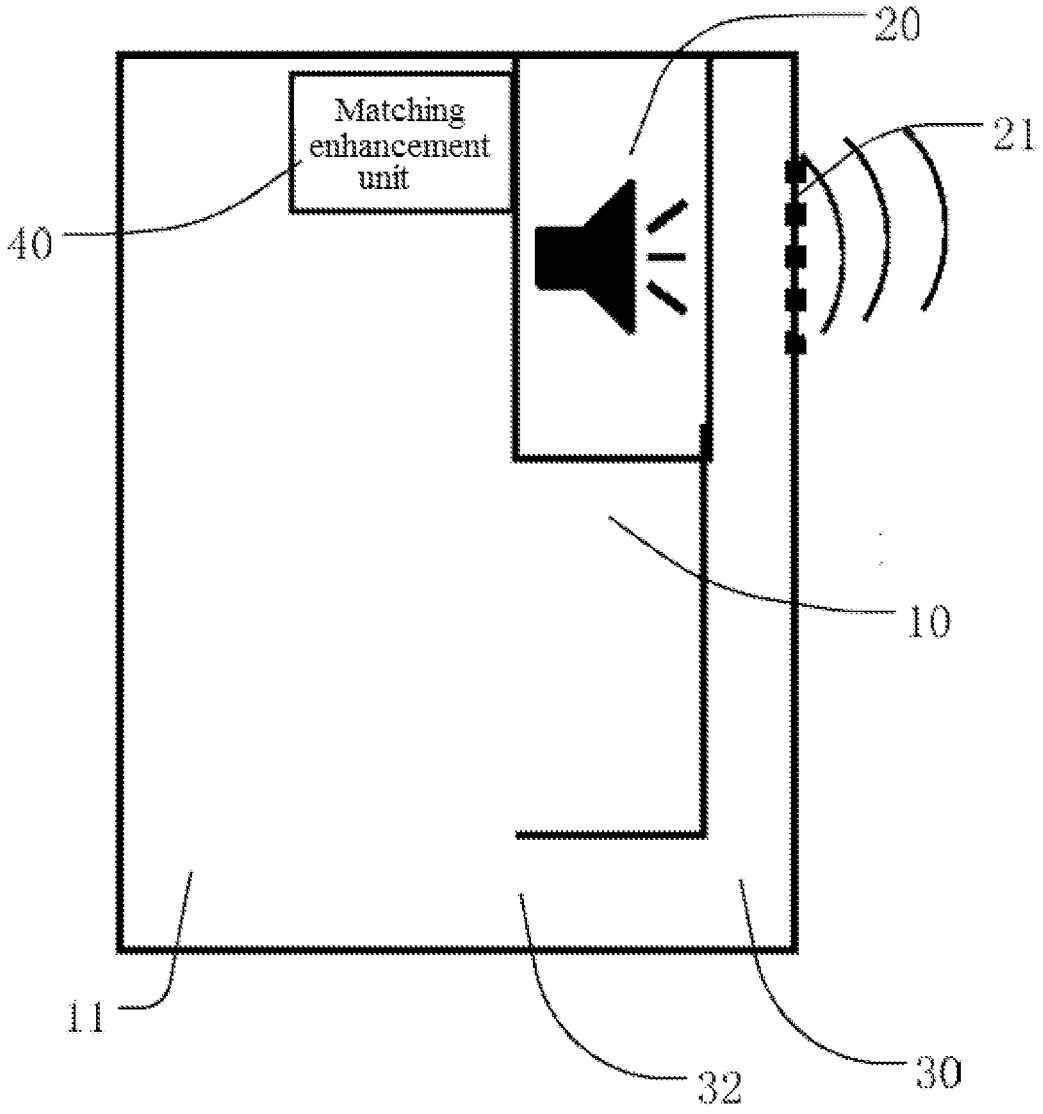
FIG. 11 is a diagram showing the third embodiment of the miniature speaker module of the invention.

Preferably, the miniature speaker module is of a front porting design, the second driver formed in the inverted tube and the active driver radiate independently (FIG. 8). Or, the miniature speaker module is of a side porting design, the second driver formed in the inverted tube and the active driver radiate independently (FIG. 10). Or, the miniature speaker module is of a front porting design, and the second driver formed in the inverted tube and the active driver share the front cavity and radiate jointly (FIG. 11).

Figure 2:
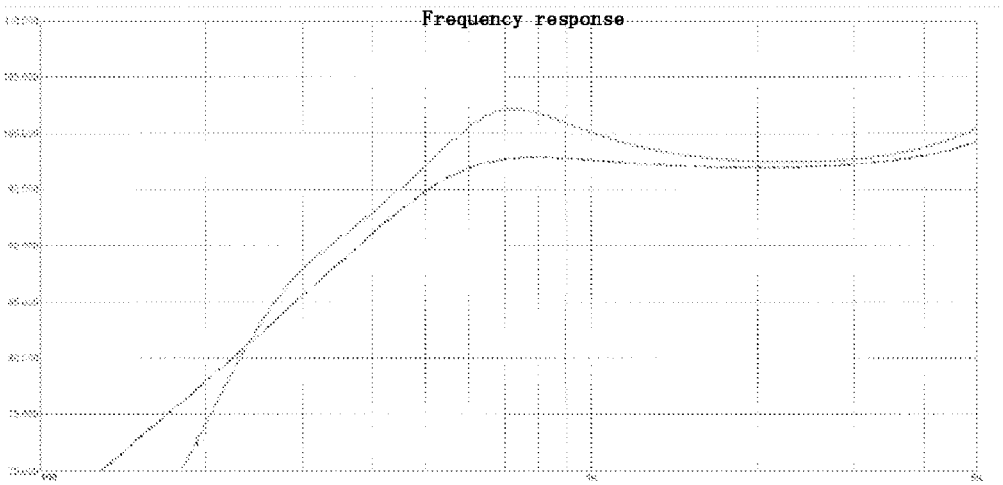
FIG. 2 is a diagram comparing a frequency response curve where the miniature speaker module of the present invention does not matching enhancement process the signals input into the active driver of the miniature speaker with a frequency response curve of the miniature speaker module designed with a traditional closed cavity.

FIG. 2 is a diagram comparing a frequency response curve where the miniature speaker module of the present invention does not matching enhancement process the signals input into the active driver of the miniature speaker with a frequency response curve of the miniature speaker module designed with a traditional closed cavity, wherein the horizontal axis is frequency, the solid line is a frequency response curve where the miniature speaker module of the present invention does not matching enhancement process the signals input into the active driver of the miniature speaker, and the dotted line is a frequency response curve of the miniature speaker module designed with a traditional closed cavity. FIG. 2 shows that, the low frequency sensitivity of the miniature speaker module processed by step S100 (i.e., additionally provided with an inverted tube) is improved at least by 2 dB in the frequency bands (e.g. 300 Hz to 500 Hz in FIG. 2) below the low-frequency resonant frequency F0 (see FIG. 5, it is about 600 Hz) relative to the existing miniature speaker module designed with a closed cavity. That is to say, the low-frequency response of the miniature speaker module is improved due to the joint radiation of the second driver formed in the inverted tube and the active driver.

Figure 3:
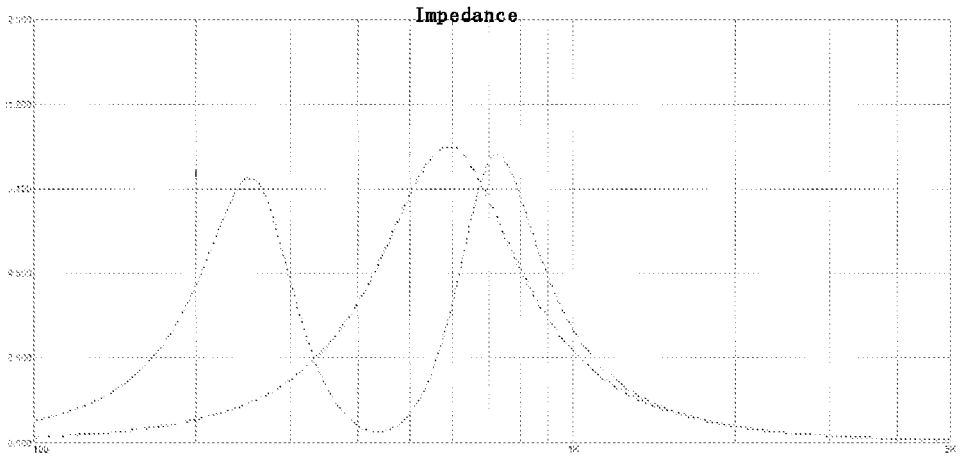
FIG. 3 is a diagram comparing an impedance curve where the miniature speaker module of the present invention does not matching enhancement process the signals input into the active driver of the miniature speaker with an impedance curve of the miniature speaker module designed with a traditional closed cavity.
Figure 4:
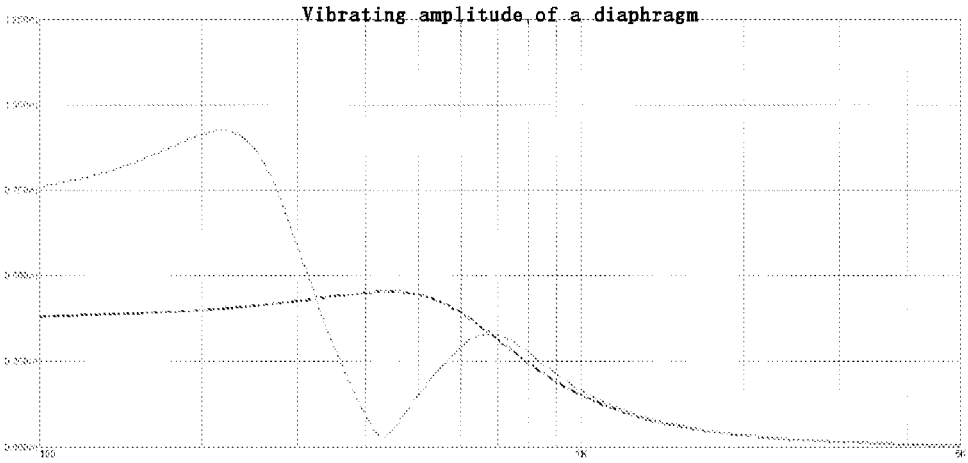
FIG. 4 is a diagram comparing a film vibration amplitude curve where the miniature speaker module of the present invention does not matching enhancement process the signals input into the active driver of the miniature speaker with a film vibration amplitude curve of the miniature speaker module designed with a traditional closed cavity.

FIG. 3 is a diagram comparing an impedance curve where the miniature speaker module of the present invention does not matching enhancement process the signals input into the active driver of the miniature speaker with an impedance curve of the miniature speaker module designed with a traditional closed cavity, wherein the horizontal axis is frequency, the solid line is an impedance curve where the miniature speaker module does not matching enhancement process the signals input into the active driver of the miniature speaker in the present invention, and the dotted line is an impedance curve of the miniature speaker module designed with a traditional closed cavity. It can be clearly seen that in the low-frequency band, due to the second driver formed in the inverted tube, the voice coil vibration amplitude in the low-frequency band is limited, so the impedance curve has a local low point (in this embodiment, it is around 420 Hz, and the frequency point of 420 Hz is called Fb) when the miniature speaker module of the present invention does not matching enhancement process the input signals of the active driver. FIG. 4 is a diagram comparing a film vibration amplitude curve where the miniature speaker module of the present invention does not matching enhancement process the signals input into the active driver of the miniature speaker with a film vibration amplitude curve of the miniature speaker module designed with a traditional closed cavity, wherein the horizontal axis is frequency, the solid line is a film vibration amplitude curve where the miniature speaker module of the present invention does not matching enhancement process the signals input into the active driver of the miniature speaker, and the dotted line is a film vibration amplitude curve of the miniature speaker module designed with a traditional closed cavity. It can be clearly seen that in the low-frequency band, due to the second driver formed in the inverted tube, there is a local lowest point Fb (420 Hz) of the vibrating amplitude in the low frequency when the miniature speaker module of the present invention does not matching enhancement process the signals input into the active driver of the miniature speaker. Based on such characteristic, a matching enhancement processing algorithm shown in FIG. 5 is designed in the embodiment of the present invention.

Figure 5:
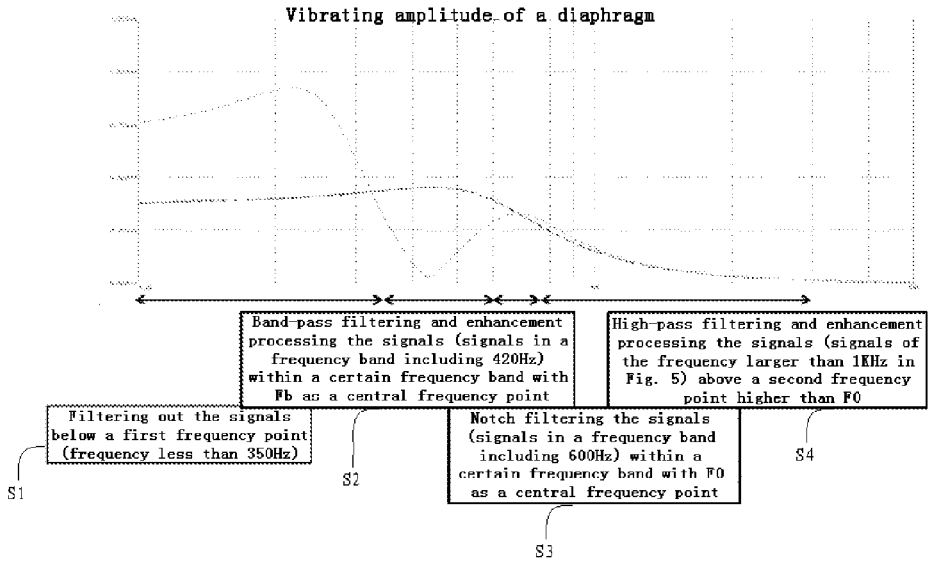
FIG. 5 is a diagram showing a matching enhancement processing algorithm designed for the vibrating amplitude characteristics of the miniature speaker module additionally provided with an inverted tube as shown in FIG. 4.

FIG. 5 is a diagram showing a matching enhancement processing algorithm designed for the vibrating amplitude characteristics of the miniature speaker module additionally provided with an inverted tube as shown in FIG. 4. Referring to FIG. 5, the matching enhancement processing algorithm is specifically:

S1, filtering out the signals below a first frequency point (the signals in the low frequency and large vibrating amplitude regions in FIG. 5, i.e., the signals having the frequency less than 350 Hz), so as to filter out the signals in the frequency band below Fb, which enable the vibrating amplitude beyond a range allowed by the diaphragm of the active driver;

The first frequency point is a frequency point lower than Fb. Here, the signals below the first frequency point are called very-low-frequency signals, which means that the vibrating amplitude of the diaphragm is larger in this frequency band and is beyond an allowable range of the diaphragm of the active driver (approximate to/reach/beyond the amplitude allowed by a diaphragm). Very-low-frequency signals are generally filtered out by a high-pass filter, and the filter cutoff frequency is determined by the vibrating amplitude curve of the diaphragm of the active driver and the property of the diaphragm itself. For example, if it is assumed that the filter cutoff frequency is a first frequency point, the frequency point that is below Fb and allows the vibrating amplitude curve of the active driver of the miniature speaker module additionally provided with an inverted tube reach an amplitude allowed by the diaphragm may be selected as the first frequency point and the filter cutoff frequency.

S2, band-pass filtering and enhancement processing the signals (signals within a frequency band including 420 Hz in FIG. 5) within a certain frequency band with Fb as a central frequency point, to achieve low-frequency dive and bass boost.

By making use of the characteristics that the vibrating amplitude of the diaphragm has dip in Fb region as shown in FIG. 5, the signals on this frequency band are enhanced, thereby realizing low-frequency dive and bass boost, and meanwhile enabling the vibration amplitude of the film to still maintain within a necessary range (the necessary range in which the vibration amplitude of the film in this embodiment maintains is determined according to the size of the elements of the miniature speaker module); wherein, Fb is a frequency point corresponding to a lowest vibrating amplitude point, in the low frequency below F0, on the vibrating amplitude curve of the active driver of the miniature speaker module additionally provided with an inverted tube (in this embodiment, Fb is at 420 Hz). The above mentioned certain frequency band with Fb as a central frequency point can be determined by a preset threshold and the vibrating amplitude curve of the diaphragm of the active driver of the miniature speaker module additionally provided with an inverted tube, e.g., two frequency points allowing the vibrating amplitude curve of the active driver of the miniature speaker module additionally provided with an inverted tube to reach a preset threshold (the threshold is set as required, for example, the threshold may be 60% or 70% of the amplitude allowed by a diaphragm) may be selected as two endpoints of the frequency band.

S3, notch filtering the signals within a certain frequency band with F0 as a central frequency point (signals within a frequency band including 600 Hz in FIG. 5), to avoid too large vibrating amplitude of the diaphragm of the active driver near F0.

Since the processing is not suitable for excessive enhancement due to larger vibrating amplitude of the diaphragm near F0, notch filtering is performed to avoid too large vibrating amplitude; wherein F0 is a low frequency resonance point of the miniature speaker module additionally provided with an inverted tube (in this embodiment, F0 is at 600 Hz). The above certain frequency band with F0 as a central frequency point can be determined by a preset threshold and the vibrating amplitude curve of the active driver of the miniature speaker module additionally provided with an inverted tube. For example, two frequency points allowing the amplitude curve of the active driver of the miniature speaker module additionally provided with an inverted tube to reach a preset threshold (the threshold is set as required, for example, the threshold can be 40% or 60% of the amplitude allowed by a diaphragm) may be selected as two endpoints of the frequency band.

S4, high-pass filtering and enhancement processing the signals (signals in high frequency and small vibrating amplitude regions in FIG. 5, i.e. signals with a frequency above 1 KHz) above a second frequency point higher than F0 to enhance mid and high frequency response using the characteristics that the diaphragm of the active driver has a smaller vibrating amplitude in mid and high frequency bands. Since the vibrating amplitude of a diaphragm is smaller in high frequency bands, the high frequency signals are enhancement processed. The second frequency point is a frequency point higher than F0. It can be seen from the vibrating amplitude characteristics that, under a frequency higher than F0, the vibrating amplitude of the diaphragm decreases with the increase of the frequency. Therefore, the second frequency point higher than F0 may be selected, wherein an vibrating amplitude of the diaphragm corresponding to the frequency above the second frequency point is less than a preset threshold (the threshold can be set as required, for example, the threshold may be 20% or 30% or 40% of an amplitude allowed by the diaphragm). By high-pass filtering and enhancement processing the signals having a frequency higher than the second frequency point, mid and high frequency response can be enhanced.

Therefore, with the help of the algorithm shown in FIG. 5, the frequency response of the entire system should have great improvement.

Figure 6:
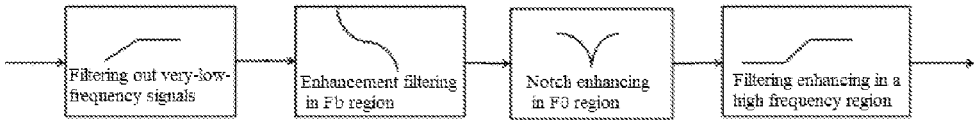
FIG. 6 is a diagram showing the specific process of the matching enhancement processing algorithm as designed in FIG. 5 for the miniature speaker module additionally provided with an inverted tube, at different frequencies.

FIG. 6 is a diagram showing the matching enhancement processing algorithm as designed in FIG. 5 for the miniature speaker module additionally provided with an inverted tube. Referring to FIG. 6, the signals input into the active driver of the miniature speaker module additionally provided with an inverted tube in the present invention is processed one by one as follows: filtering out very-low-frequency signals, enhancement filtering in the frequency bands near Fb, notch filtering in the frequency bands near F0, and performing enhanced filtering in a high frequency region. It needs to be noted that the steps in 4 blocks in FIG. 6 are not limited to the order currently shown in FIG. 6, and the steps in the 4 blocks may be performed in any order in other embodiments of the present invention.

Further, Fb can be adjusted by changing the tube length and diameter of the inverted tube; and F0 can be adjusted by changing the diaphragm characteristics and voice coil quality of the active driver. And, according to the value of F0 and Fb and the characteristics of the power amplifier and the diaphragm's vibrating amplitude, one or more of the following parameters of the filter are adjusted in the matching enhancement process: Q value (quality factor), order, frequency band attenuation parameter and cutoff frequency.

Matching enhancement process and filter amplification in the present invention can be implemented in many ways. They may be implemented by software or hardware or may be implemented by analog or digital signals. But, the core framework of implementation should conform to FIG. 5 and FIG. 6, especially the portion of bass boost with Fb as center.

Figure 7:
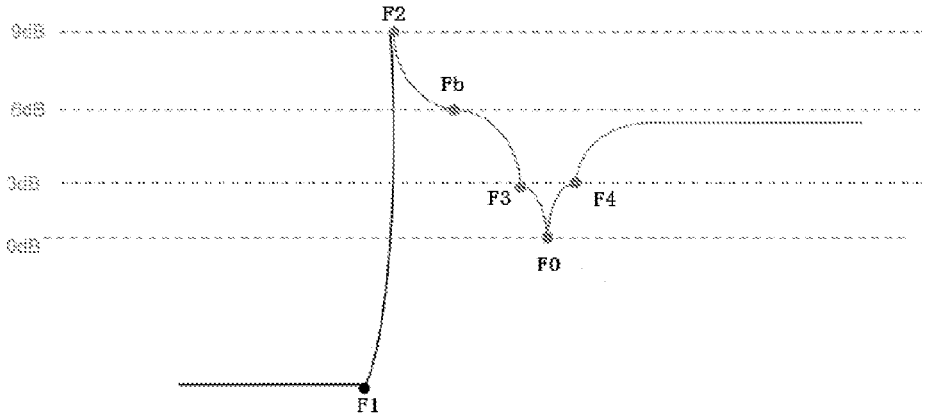
FIG. 7 is a diagram showing the specific process of the matching enhancement processing algorithm as designed in FIG. 5 and FIG. 6 for the miniature speaker module additionally provided with an inverted tube, at different frequencies.

FIG. 7 is a diagram showing the specific process of the matching enhancement processing algorithm as designed in FIG. 5 and FIG. 6 for the miniature speaker module additionally provided with an inverted tube, at different frequencies. Referring to FIG. 7, in this embodiment, the matching enhancement processing algorithm is specifically:

filtering out signals of the frequencies below a frequency point F1, to filter out the signals having a vibrating amplitude beyond an allowable range of the diaphragm of the active driver on frequency bands below Fb, wherein the frequency point F1 is a frequency point allowing the vibrating amplitude curve of the active driver of the miniature speaker module additionally provided with an inverted tube to reach an amplitude allowed by the diaphragm;

band-pass filtering and enhancement processing the signals within a certain frequency band with Fb as a central frequency point; the signals within a certain frequency band being signals with a frequency band ranging from F2 to F3, wherein frequency points F2 and F3 are two frequency points allowing the vibrating amplitude curve of the active driver of the miniature speaker module additionally provided with an inverted tube to reach a preset threshold, respectively;

notch filtering the signals within a certain frequency band with F0 as a central frequency point, the signals within a certain frequency band being signals with a frequency band ranging from F3 to F4, wherein frequency points F3 and F4 are two frequency points allowing the vibrating amplitude curve of the active driver of the miniature speaker module additionally provided with an inverted tube to reach a preset threshold, respectively; and high-pass filtering and enhancement processing the signals having frequency above the frequency point F4, wherein the vibrating amplitude of the diaphragm corresponding to the frequency above the frequency point F4 is less than a preset threshold;

wherein, F1<F2<Fb<F3<F0<F4; and specific values of the frequency points F1, F2, Fb, F3, F0 and F4 are all determined according to specific parameters of the miniature speaker.

For example, Fb is adjusted by changing the tube length and diameter of the inverted tube, and F0 is adjusted by changing the diaphragm characteristics and voice coil quality of the active driver. The parameters, such as Q value, order, frequency band attenuation and cutoff frequency of a filter used, can be determined by a person skilled in the art according to actual needs and the known parameters (the performance of an amplifier, the diaphragm of a speaker, the property of voice coil, etc.) of the miniature speaker module; meanwhile, upper limits of algorithm complementation are adjusted by comprehensively taking electrical and mechanical performances of the system into consideration, to avoid the damage to a device resulted from excessive drive, which will not be repeated here.

FIG. 8 is a diagram showing the first embodiment of the miniature speaker module of the invention. The miniature speaker module comprises a cavity 10, and an active driver 20 disposed within the cavity 10, an inverted tube 30 and a matching enhancement unit 40.

The inverted tube 30 is disposed in the rear cavity 11 of the miniature speaker module. The rear cavity 11 of this embodiment is a portion of the cavity 10 that is located in the rear of the active driver 20. An air inlet 32 of the inverted tube 30 in the present invention is disposed at a position within the rear cavity 11 in a preset distance to the active driver 20 to form a second driver in the inverted tube 30 because the diaphragm of the active driver 20 squeezes the air in the rear cavity 11 when the active driver 20 works. The second driver and the active driver 20 radiate jointly such that the low frequency response of the miniature speaker module is enhanced. The airflow inside the inverted tube 30 can well conduct the heat out from the rear cavity 11, thereby effectively improving reliability and power cap of the miniature speaker module.

The miniature speaker module in this embodiment is of a front porting design, the second driver formed in the inverted tube 30 and the active driver 20 radiate independently. To be more specific, referring to FIG. 8, in the miniature speaker module in the first embodiment of the present invention, the inlet 32 of the inverted tube 30 is disposed within the rear cavity 11 in a preset distance to the active driver 20, a sound outlet 31 is disposed at a position facing the porting direction of the inverted tube 30, and a sound outlet 21 is disposed at a position facing the porting direction of the active driver 20. The sound outlet 31 and the sound outlet 21 are disposed at intervals at the porting side of the miniature speaker module.

Preferably, the elements of the miniature speaker module of this embodiment are small in size, especially adaptive for use in mobile phones, tablet computers and other mobile devices, so the sound outlet of the inverted tube 30 and the sound outlet of the active driver 20 in this embodiment are located at the same side of the miniature speaker module (i.e., porting side).

The matching enhancement unit 40 is for matching enhancement processing the input signals of the active driver 20 according to the vibrating amplitude characteristics of the diaphragm (diaphragm of the active driver 20) of the miniature speaker module additionally provided with the inverted tube 30. In this embodiment, the matching enhancement unit 40 is an audio processing chip connected to the active driver 20, and of course, it may also be an audio processing circuit integrated in the active driver 20. It needs to be further described that the matching enhancement unit 40 in the present invention can be implemented in many ways, and it may be implemented by software or hardware or may be implemented by analog or digital signals. But, the core framework of implementation should conform to FIG. 5 and FIG. 6, especially the portion of bass boost with Fb as center. The characteristics of the matching enhancement unit 40 of the embodiment are determined according to the specific parameters of the active driver 20. It needs to be further described that the frame outside the active driver 20 (i.e. the frame outside the horn-shaped icon) in FIG. 8, FIG. 10 and FIG. 11 indicates the position of the active driver 20, which cannot be understood as that there is a closed frame outside the active driver 20 or be understood in other ways.

Figure 9:
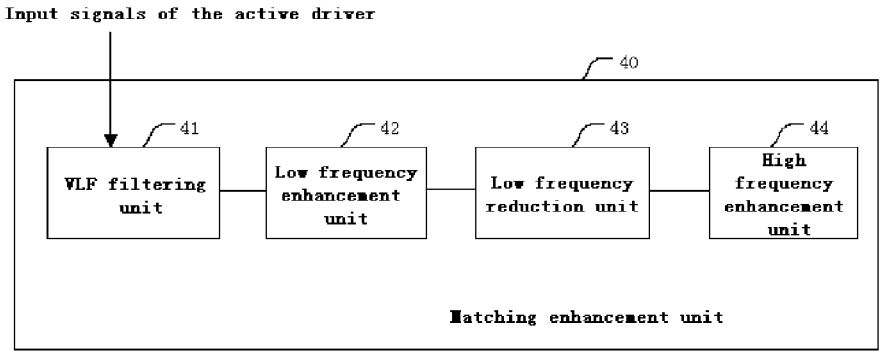
FIG. 9 is a block diagram showing the matching enhancement unit comprised in the miniature speaker module of the invention.

FIG. 9 is a block diagram showing the matching enhancement unit comprised in the miniature speaker module of the invention. The matching enhancement unit 40 comprises a low frequency enhancement unit 42 for band-pass filtering and enhancement processing the signals within a certain frequency band with Fb as a central frequency point, to achieve low-frequency dive and bass boost; wherein Fb is a frequency that the dip of the diaphragm vibrating amplitude curve of the miniature speaker module additionally provided with the inverted tube 30 at low frequencies corresponds to, lower than a low frequency resonant frequency (see FIG. 4 and FIG. 5). While band-pass filtering and enhancement processing the signals within a certain frequency band with Fb as a central frequency point to enhance the low frequency response of the miniature speaker module, the diaphragm vibration amplitude can still be maintained in a necessary range to further enhance the low frequency response of the miniature speaker module.

Further, the matching enhancement unit 40 further comprises a VLF filtering unit 41, a low frequency reduction unit 43, and a high frequency enhancement unit 44.

The VLF filtering unit 41 filters out the signals below a first frequency point that is a frequency point lower than Fb, so as to filter out the signals having a vibrating amplitude beyond an allowable range of the diaphragm of the active driver on frequency bands below Fb. The low frequency reduction unit 43 notch filters the signals within a certain frequency band with F0 as a central frequency point, to avoid too large vibrating amplitude of the diaphragm of the active driver near F0. The high frequency enhancement unit 44 high-pass filters and enhancement processes the signals above a second frequency point higher than F0 to further enhance mid and high frequency output using the characteristics that the diaphragm of the active driver has a smaller vibrating amplitude in mid and high frequency bands. Therefore, the miniature speaker module of the present invention improves the sensitivity of low frequencies by means of the inverted tube 30, and enhances the frequency response of the miniature speaker module on the entire frequency bands by means of the matching enhancement unit 40.

Further, in this embodiment, the VLF filtering unit 41 receives the signals input into the active driver 20 of the miniature speaker module and transmits the signals, from which the signals below the first frequency point have been filtered out, to a low frequency enhancement unit 42. The low frequency enhancement unit 42 receives signals from the VLF filtering unit 41 and transmits the signals, in which the signals within a certain frequency band with Fb as a central frequency point has been band-pass filtered and enhancement processed, to the low frequency reduction unit 43. The low frequency reduction unit 43 receives signals from the low frequency enhancement unit 42 and transmits the signals, in which the signals within a certain frequency band with F0 as a central frequency point have been notch filtered, to the high frequency enhancement unit 44. The high frequency enhancement unit 44 receives signals from the low frequency reduction unit 43 and high-pass filters and enhancement processes the signals above a second frequency point higher than F0, thereby completing the matching enhancement process of the signals input into the active driver 20 of the miniature speaker module.

However, a person skilled in the art should appreciate that the signal connection relationship between the VLF filtering unit 41, the low frequency enhancement unit 42, the low frequency reduction unit 43 and the high frequency enhancement unit 44 can be adjusted according to requirement and is not limited to the connection relationship shown in FIG. 9.

The miniature speaker module shown in FIG. 8, FIG. 10 and FIG. 11 of the present invention can adjust Fb by changing the tube length and diameter of the inverted tube; and/or, adjust F0 by changing the diaphragm characteristics and voice coil quality of the active driver; and adjust one or more of the following parameters of the filter in the matching enhancement process: Q value, order, frequency band attenuation parameter and cutoff frequency, according to the value of F0 and Fb and the characteristics of the power amplifier of the system and the diaphragm's vibrating amplitude.

FIG. 10 is a diagram showing the second embodiment of the miniature speaker module of the invention. The miniature speaker module of the second embodiment is substantially the same with the miniature speaker module of the first embodiment shown in FIG. 8. The miniature speaker module of the second embodiment is of a side porting design, and the second driver formed in the inverted tube and the active driver radiate independently. More specifically, an air inlet 32 of the inverted tube 30 is disposed within the rear cavity 11, a sound outlet 31 is disposed at a position facing the inverted tube 30, and a sound outlet 21 is disposed at a position vertical to the porting direction of the active driver 20. By means of the side porting design and the adjacency of the sound outlet 31 and the sound outlet 21, the lightness and thinness of elements are promoted.

FIG. 11 is a diagram showing the third embodiment of the miniature speaker module of the invention. The miniature speaker module of the third embodiment is substantially the same with the miniature speaker module of the first embodiment shown in FIG. 8. The miniature speaker module of the third embodiment is of a front porting design, and the second driver formed in the inverted tube and the active driver radiate jointly. More specifically, an air inlet 32 of the inverted tube 30 is disposed at a position within the rear cavity 11 in a preset distance to the active driver 20, and a common sound outlet 21 is disposed at a position facing the porting direction of the active driver 20. Due to the front porting design and since the inverted tube 30 and the active driver 20 share the front cavity, the design of the structure of the third embodiment is simpler.

The present invention further discloses an electronic device, comprising the miniature speaker module according to any one of the foregoing embodiments. The electronic device of the present invention is a small sized and portable electronic device. Preferably, the electronic device disclosed by the present invention is a mobile phone, a tablet computer, a tablet television set or a notebook computer.

The foregoing descriptions merely show preferred embodiments of the present invention, and are not intended to limit the protection scope of the present invention. Any modification, equivalent replacement and improvement made within the spirit and principle of the present invention shall fall into the protection scope of the present invention.

The invention claimed is:

1. A method for enhancing the frequency response of a miniature speaker module, wherein the method comprises the steps of:

additionally providing an inverted tube in a rear cavity of the miniature speaker module to form a second driver in the inverted tube when an active driver works, the second driver and the active driver radiating jointly;

wherein, after the inverted tube is additionally provided in the miniature speaker module, at least one vibrating amplitude characteristic of a diaphragm of the active driver shows a local dip on frequency bands below a resonant frequency point F0, and the lowest point of the local dip is corresponding to a frequency point Fb; and matching enhancement processing the input signals of the active driver according to the at least one vibrating amplitude characteristic of the diaphragm of the active driver of the miniature speaker module additionally provided with the inverted tube;

wherein, the matching enhancement processing the input signals of the active driver according to the at least one vibrating amplitude characteristic of the diaphragm of the active driver of the miniature speaker module additionally provided with the inverted tube comprises:

filtering out the signals below a first frequency point that is a frequency point lower than Fb, so as to filter out the signals having a vibrating amplitude beyond an allowable range of the diaphragm of the active driver on frequency bands below Fb;

band-pass filtering and enhancement processing the signals within a certain frequency band with Fb as a central frequency point, to achieve low-frequency dive and bass boost;

notch filtering the signals within a certain frequency band with F0 as a central frequency point, to avoid too large vibrating amplitude of the diaphragm of the active driver near F0; and high-pass filtering and enhancement processing the signals above a second frequency point higher than F0 to further enhance mid and high frequency output using the characteristics that the diaphragm of the active driver has a smaller vibrating amplitude in mid and high frequency bands.

2. The method according to claim 1, wherein, the miniature speaker module is of a front porting design, the second driver formed in the inverted tube and the active driver radiating independently;

or, the miniature speaker module is of a side porting design, the second driver formed in the inverted tube and the active driver radiating independently;

or, the miniature speaker module is of a front porting design, the second driver formed in the inverted tube and the active driver sharing a front cavity and radiating jointly.

3. The method according to claim 1, wherein the method further comprises:

adjusting Fb by changing the tube length and diameter of the inverted tube; and/or adjusting F0 by changing the diaphragm characteristics and voice coil quality of the active driver;

and adjusting one or more of the following parameters of the filter in the matching enhancement process: Q value, order, frequency band attenuation parameter and cutoff frequency, according to the value of F0 and Fb and the characteristics of the power amplifier and the diaphragm's vibrating amplitude.

4. A miniature speaker module, comprising a cavity and an active driver disposed in the cavity, wherein the miniature speaker module further comprises an inverted tube and a matching enhancement unit;

the inverted tube being disposed in a rear cavity to form a second driver in the inverted tube when an active driver works, the second driver and the active driver radiating jointly;

wherein, after the inverted tube is additionally provided in the miniature speaker module, at least one vibrating amplitude characteristic of a diaphragm of the active driver shows a local dip on frequency bands below a resonant frequency point F0, and the lowest point of the local dip is corresponding to a frequency point Fb; and the matching enhancement unit being for matching enhancement processing the input signals of the active driver according to the at least one vibrating amplitude characteristic of the diaphragm of the active driver of the miniature speaker module additionally provided with the inverted tube;

wherein, the matching enhancement unit comprises:

a very low frequency filtering unit for filtering out the signals below a first frequency point that is a frequency point lower than Fb so as to filter out the signals having a vibrating amplitude beyond an allowable range of the diaphragm of the active driver on frequency bands below Fb;

a low frequency enhancement unit for band-pass filtering and enhancement processing the signal within a certain frequency band with Fb as a central frequency point, to achieve low-frequency dive and bass boost;

a low frequency reduction unit for notch filtering the signals within a certain frequency band with F0 as a central frequency point, to avoid too large vibrating amplitude of the diaphragm of the active driver near F0; and a high frequency enhancement unit for high-pass filtering and enhancement processing the signals above a second frequency point higher than F0 to further enhance mid and high frequency output using the characteristics that the diaphragm of the active driver has a smaller vibrating amplitude in mid and high frequency bands.

5. The miniature speaker module according to claim 4, wherein, the miniature speaker module is of a front porting design, the second driver formed in the inverted tube and the active driver radiating independently;

or, the miniature speaker module is of a side porting design, the second driver formed in the inverted tube and the active driver radiating independently;

or, the miniature speaker module is of a front porting design, the second driver formed in the inverted tube and the active driver sharing a front cavity and radiating jointly.

6. The miniature speaker module according to claim 4, wherein,

Fb is adjusted by changing the tube length and diameter of the inverted tube; and/or F0 is adjusted by changing the diaphragm characteristics and voice coil quality of the active driver;

and one or more of the following parameters of the filter in the matching enhancement process: Q value, order, frequency band attenuation parameter and cutoff frequency, are adjusted according to the value of F0 and Fb and the characteristics of the power amplifier of the system and the diaphragm's vibrating amplitude.

7. An electronic device, comprising the miniature speaker module according to claim 4.

8. The electronic device according to claim 7, wherein the electronic device is a mobile phone, a tablet computer, a tablet television or a notebook computer.

* * * * *